United States Patent [19]

Johnson

[11] 4,204,459

[45] May 27, 1980

[54] COMBINATION CHECK AND FLOW CONTROL VALVE FOR HYDRAULIC SYSTEMS

[75] Inventor: Howard L. Johnson, Joliet, Ill.

[73] Assignee: Caterpillar Tractor Co., Peoria, Ill.

[21] Appl. No.: 897,895

[22] Filed: Apr. 19, 1978

[51] Int. Cl.[2] ..... F15B 11/08; F15B 13/042

[52] U.S. Cl. ..... 91/445; 91/447; 137/596.2

[58] Field of Search ..... 91/420, 445, 447, DIG. 2; 137/596.2

[56] References Cited

U.S. PATENT DOCUMENTS

| | | | |
|---|---|---|---|
| 3,213,874 | 10/1965 | Schmiel et al. | 91/420 |
| 3,464,320 | 9/1969 | Richardson | 91/420 |
| 3,570,519 | 3/1971 | Bianchetta | 137/101 |
| 3,658,090 | 4/1972 | Kowalski et al. | 137/596 |
| 3,763,746 | 10/1973 | Walters | 91/433 |
| 3,788,401 | 1/1974 | Scheidt et al. | 91/445 X |
| 3,795,255 | 3/1974 | Malott et al. | 91/420 X |
| 3,972,267 | 8/1976 | Haak et al. | 91/445 |
| 4,006,667 | 2/1977 | Bianchetta et al. | 91/445 |
| 4,088,151 | 5/1978 | Schurger | 91/445 X |

*Primary Examiner*—Irwin C. Cohen
*Attorney, Agent, or Firm*—Wegner, Stellman, McCord, Wiles & Wood

[57] ABSTRACT

A hydraulic system including a hydraulic pump, a hydraulic motor having at least one port and a hydraulic reservoir. A main spool valve is interposed between the motor and the pump and reservoir and has a spool shiftable between positions connecting the pump to the port, connecting the reservoir to the port, and blocking fluid flow to or from the port. A single combination check and flow control valve is interposed between the main spool valve and the port. A fluid responsive surface opens the combination valve to permit relatively free flow of fluid therethrough when the spool is in the first mentioned position thereof. A pressure responsive surface and a control valve provides for partial opening of the combination valve to meter fluid flow therethrough when the spool is in the second position thereof. A spring is operative to close the combination valve to prevent fluid flow therethrough when the spool is in the last mentioned position thereof.

8 Claims, 1 Drawing Figure

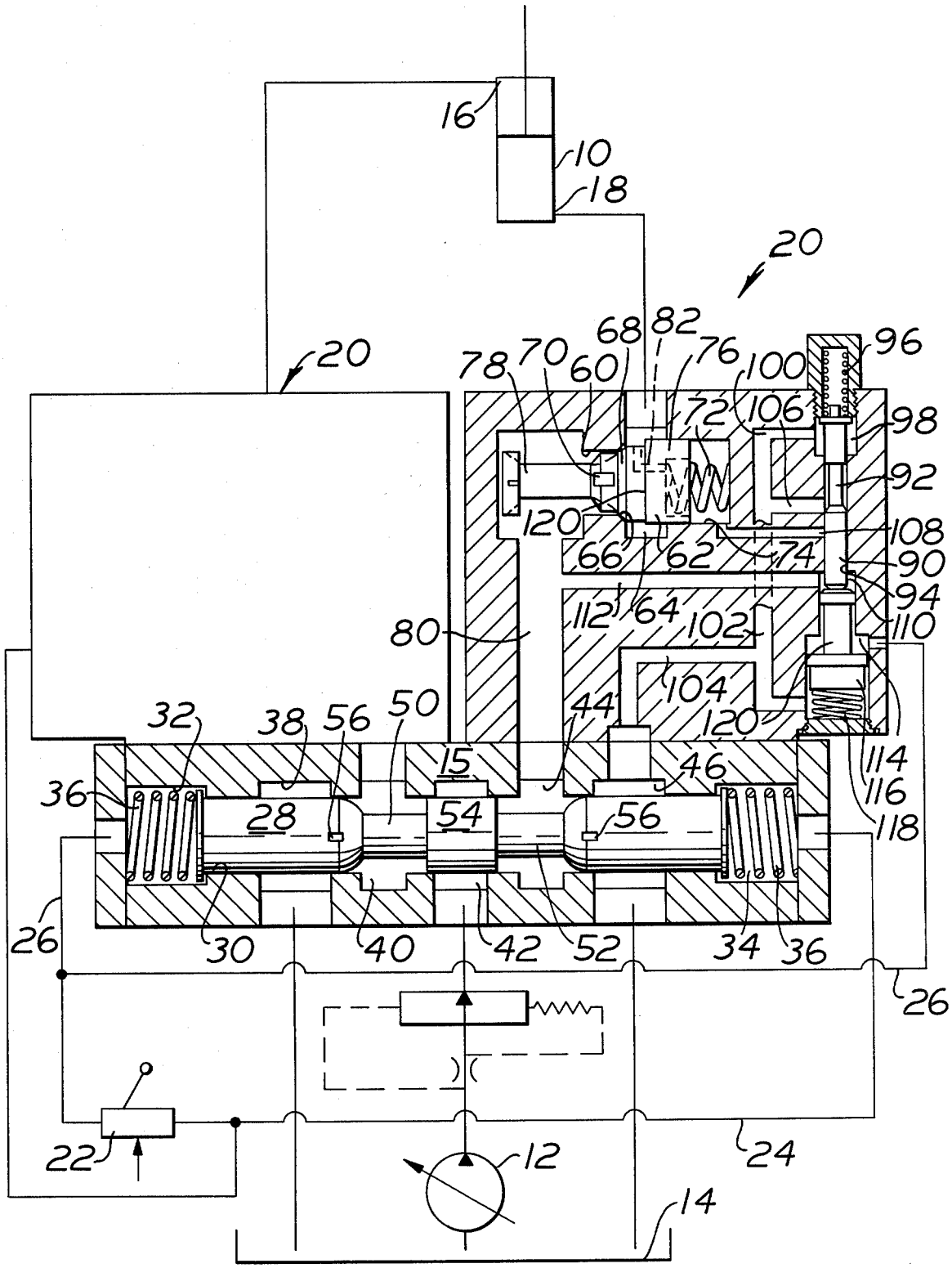
16
10
18
20
20
68
82
78
70
60
76
100
96
72
106
98
92
120
108
66
62
74
90
94
112
64
102
110
80
104
44
120
32
38
56
50
15
46
114
36
28
54
56
116
118
26
30
40
42
52
34
36
26
22
12
24
14

COMBINATION CHECK AND FLOW CONTROL VALVE FOR HYDRAULIC SYSTEMS

BACKGROUND OF THE INVENTION

This invention relates to hydraulic systems of the type requiring relatively large, but variable, flow rates from a hydraulic pump to a hydraulic motor.

In hydraulic systems having hydraulic motors, fairly high flow rates may be encountered. Control over the flow rates is provided by a control valve and where variable flow rates are encountered, the control valve will typically be in the form of a main spool valve.

Spool valves are utilized because of their excellent ability to provide relatively fine control over fluid flow at any of a variety of differing rates. However, when used in systems having relatively large flow rates, the valve must necessarily be of large size. And, it is well known in the art that the leakage encountered in a spool valve increases at a considerable rate as the size of the valve increases.

Thus, when used to control movement of hydraulic cylinders or rotary hydraulic motors, in systems whereat a so-called "neutral" condition is desired, the loading on the hydraulic motor, when the spool valve is commanding a neutral condition, may force hydraulic fluid through the leakage path inherently present in the spool valve. Consequently, the load will tend to creep.

As a result of this difficulty, typical hydraulic systems featuring large spool valves are also provided with a check valve interposed between the spool valve and the hydraulic motor which will allow relatively free flow of fluid from a pump through the main spool valve to the motor to cause the same to change its position. Conversely, when the spool is not set to direct fluid to the cylinder, the check valve, which frequently will be a poppet type valve or other valve having very low leakage, will close to prevent creeping when the spool is shifted to a neutral condition.

At the same time, in many hydraulic systems, there is the possibility that a so-called negative load condition may come into existence. This will occur when the load is acting in concert with the application of fluid to the motor and/or the relief of fluid from the motor. Because the two forces are acting in the same direction, there may result a more rapid movement of the load than is desired.

To solve this difficulty, the prior art has resorted to the provision of so-called flow control valves which control the rate of exit of hydraulic fluid from a hydraulic motor. As a negative load condition increases in severity, the flow control valve will begin to close, thereby tending to retard the rate of fluid relief from the motor to slow down its movement and that of the load controlled thereby. And, in the usual case, a further valve will be provided for the purpose of controlling the flow control valve.

As a result, in a typical system of the type described, at least four valves are employed solely to provide the type of control mentioned previously in connection with fluid flow from but a single port of a hydraulic motor. Needless to say, considerable expense is involved. Moreover, in many instances, the space required by the number of valves may be somewhat greater than that available at the place of installation of the system.

SUMMARY OF THE INVENTION

The present invention is directed to overcoming one or more of the above problems.

According to the present invention, there is provided a hydraulic system including a hydraulic pump, a hydraulic motor having at least one port, and a hydraulic reservoir. A main spool valve is interposed between the motor and the pump and reservoir and has a spool shiftable between positions (a) connecting the pump to the port, (b) connecting the reservoir to the port, and (c) blocking fluid flow to or from the port. A single, combination check and flow control valve is interposed between the main spool valve and the port. Means are provided for opening the combination valve to permit relatively free flow of fluid therethrough when the spool is in position (a) thereof and means are provided for partially opening the combination valve to meter fluid flow therethrough when the spool is in position (b) thereof. Lastly, means are provided for closing the combination valve to prevent fluid flow therethrough when the spool is in position (c) thereof.

As a consequence of the foregoing construction, the need for separate check and fluid flow control valves is eliminated, reducing the number of valves required as well as the space required at a given installation to receive the valve.

Other objects and advantages will become apparent from the following specification taken in connection with the accompanying drawings.

DESCRIPTION OF THE DRAWING

The FIGURE is a somewhat schematic, sectional view of a hydraulic system made according to the invention.

DESCRIPTION OF THE PREFERRED EMBODIMENT

An exemplary embodiment of a hydraulic system made according to the invention is illustrated in the FIGURE and is seen to include a hydraulic motor 10 in the form of a double-acting hydraulic cylinder. However, it is to be understood that the motor 10 may be a rotary output motor and that the invention can also be used with efficacy in single-acting motors as well. The system further includes a hydraulic pump 12 which may be of the variable displacement type and a hydraulic reservoir 14. A main spool valve 15 is interposed between the motor 10, the pump 12 and the reservoir 14 for selectively connecting the pump 12 to either the rod end 16 of the motor 10 or the head end 18 of the motor 10 while connecting the opposite end to the reservoir 14, and for blocking fluid flow to or from the motor 10.

In a high capacity hydraulic system, the spool valve 15 will necessarily be relatively leaky with the consequence that it cannot perform the blocking function mentioned previously to prevent creeping of a load worked upon by the motor 10. Consequently, a combination, single check and flow control valve, generally designated 20, is interposed between each of the ports 16 and 18 and the main spool valve 15. The valves 20 are identical and each is operative to allow relatively free flow of fluid from the pump 12 to its corresponding port 16 or 18 when the main spool valve 15 is directing fluid under pressure to the corresponding valve 20. Each may also close completely to block fluid flow when the main spool valve 15 is blocking fluid flow to prevent creeping due to the leakage that would otherwise occur in the main spool valve 15. Finally, each valve 20 may be partially open to meter fluid flow from its associated port to the reservoir 14 when the other port is receiving pressurized fluid from the pump 12 to provide excellent control under so-called negative load conditions.

Principal control over the system is exercised by manipulation of a manually operated, pilot valve 22 which can be shifted to direct pilot fluid under pressure to either a line 24 or a line 26 or to neither, as is well known in the art. The spool valve 15 is a double-piloted, spring-centered spool valve and includes a spool 28 shiftable within a bore 30. A pilot chamber 32 is provided at the left end of the bore 30 while a pilot chamber 34 is provided at the right end of the bore 30. The line 24 is connected to the pilot chamber 34 while the line 26 is connected to the pilot chamber 32 and both chambers include springs 36 which abut respective ends of the spool 28 to center the same when pilot pressure is not being applied. As illustrated in the FIGURE, the spool 28 is centered.

The valve 15 includes annuluses 38, 40, 42, 44 and 46 confronting the bore 30. The annuluses 38 and 46 are in fluid communication with the reservoir 14 while the annulus 42 is connected to the output of the pump 12. The annuluses 40 and 44 are connected respectively to the left and right combination valves 20.

The spool 28 includes a pair of spaced grooves 50 and 52 separated by a central land 54. Metering slots 56 are located in the spool 28 adjacent the grooves 50 and 52 where illustrated.

When pilot pressure is applied to the chamber 32, the spool 28 will shift to the right from the position illustrated in the FIGURE so that fluid communication will be established between the annuluses 40 and 42 and fluid communication will be established between the annuluses 44 and 46 via the metering slot 56 on the right-hand portion of the spool 28. Consequently, fluid under pressure from the pump 12 will be directed via the left-hand combination valve to the port 16 of the cylinder 10 while fluid discharged from the port 18 of the cylinder 10 will be directed to the reservoir 14 via the right-hand combination valve through the metering slot 56.

When pilot pressure is applied to the chamber 34, the reverse action will occur. When pilot pressure is applied to neither chamber, the springs 36 will center the spool 28 halting all fluid communication through the valve 15, save for leakage.

The manner in which the combination valves 20 perform the functions enumerated previously will now be described. Since the structure of each is identical, one to the other, only the right-hand combination valve 20 will be described.

The valve 20 includes a bore 60 having a valve member 62 reciprocally received therein. An annulus 64 confronts the bore 60 and, at the left-hand edge of the annulus 64, there is a frusto-conical valve seat 66 which can be closed by a mating frusto-conical surface 68 on the valve member 62. To the left of the surface 68, the valve member 62 is provided with metering slots 70 while the right-hand end of the valve member 62 is engaged by a compression spring 72 which applies a leftward bias to the valve member 62 to urge the same against the seat 66. The spring 72 is received in an enlarged chamber. The right-hand end of the valve member 62 includes an enlarged head 76 which is slidingly and sealingly received within the chamber 74. The axial length of the chamber 74 is such that the valve member 62 may move sufficiently to the right, as viewed in the FIGURE, to bring a reduced diameter section 78 to the left of the metering slots 70 past the valve seat 66 so as to allow free flow of fluid through the valve from left to right, as viewed in the FIGURE.

Thus, when the valve member 62 is in the position illustrated, fluid flow will be blocked. If the valve 62 is moved to its full rightward position, relatively free flow of fluid may occur. If the valve 62 is spaced from the seat 66 but relatively close thereto, fluid flow through the valve will be metered by the slots 70 and the quantity of such flow will depend upon the proximity of the valve member 62 to the valve seat 66 in a manner well known.

The left-hand end of the bore 60 is connected via a conduit 80 to the annulus 44 while the annulus 64 is connected to the port 18 of the cylinder 10. A metering passage 82 is disposed within the valve member 62 itself and is located so as to be in continuous fluid communication with the annulus 64 and with the right-hand side of the chamber 74 irrespective of the position of the valve 62 with respect to the seat 66. Lastly, it will be observed that the right-hand end of the valve member 62 within the chamber 74 is a pressure responsive surface. Pressure applied to that surface will act in concert with the spring 72 to urge the valve member 62 towards the position against the seat 66.

There is also provided a control valve for the valve member 62 in the form of a small spool valve. The small spool valve includes a relatively small spool 90 provided with an annular groove 92. The spool 90 is reciprocal within a bore 94 and a spring 96 abuts the upper end of the spool 90 to urge the same downwardly, as viewed in the FIGURE. An enlarged chamber 98 confronts the bore 94 adjacent the spring 96 and is connected via a passage 100 to a manifold 102 which, in turn, is connected by a passage 104 to the annulus 46 in the main spool valve 15. It will, of course, be recalled that the annulus 46 is connected to the reservoir 14 with the consequence that the chamber 98 is also connected to the reservoir 14.

A port 106 opens to the bore 94 in the vicinity of the groove 92 and is also connected to the manifold 102. An additional port 108 connects to the bore 94 just below the port 106 and is connected to the chamber 74. The groove 92 serves to control the flow of fluid from the port 108 to the port 106, as will be described in greater detail hereinafter.

The lower end of the spool 90 is received in a chamber 110 which is connected via conduit 112 to the conduit 80. Thus, the pressure present in the conduit 80 will be applied to the lower end of the spool 90 while the minimal pressure, if any, within the manifold 102 will be applied to the upper end of the spool 90 along with the bias provided by the spring 96.

An enlarged chamber 114 receives a piston 116 and a biasing spring 118. The piston 116 has an extension 120 which abuts the lower end of the spool 90, as illustrated in the FIGURE, to prevent downward movement of the spool 90 to a point where fluid communication between the ports 106 and 108 could be established except when the piston 116 is moved downwardly against the bias of the spring 118. Such movement may occur as a result of a connection of the chamber 114 to the line 26. When pilot pressure is applied to the line 26 through manipulation of the valve 22, such pilot fluid pressure will be applied against the piston 116 so move the same downwardly. When such occurs, the position of the spool 90 will be responsive only to the pressure in the chamber 110 and the pressure in the chamber 98 and accompanying bias force provided by the spring 96. At all other times, the spool 90 will be precluded from movement by being locked in place by the piston 116.

Operation is as follows. Assuming pressure fluid is to be directed to the port 18 of the cylinder 10, the valve 22 will be manipulated to apply pilot pressure to the chamber 34 to shift the spool 28 to the left as viewed in the FIGURE. Fluid communication will be established between the annuluses 42 and 44 by the groove 52 to direct fluid under pressure through the conduit 80 to the bore 60. The pressure of the fluid against the valve member 62 will move the same to the right against the bias of the spring 72 to a substantially fully open position so that fluid flow will be freely directed to the cylinder 10. Any fluid trapped behind the valve member 62 in the chamber 74 may exit the same via the passage 82 into the annulus 64 during such movement.

At this time, the locking piston 116 will be in the position illustrated preventing movement of the small spool 90 since the pilot line 26 will not be provided with fluid under pressure. Relief of fluid from the port 16 will occur through the left-hand valve 20 in a fashion identical to that to be described immediately following.

If fluid is to be relieved from the port 18, the valve 22 will be manipulated to apply fluid under pressure to the pilot line 26. This will shift the spool 28 to the right, as viewed in the FIGURE, to establish fluid communication between the annulus 44 and the annulus 46 via the metering slots 56. Fluid under pressure will be directed to the port 16 through the left-hand valve 20 in a fashion identical to that mentioned previously, only via the annuluses 42 and 40 and the groove 50.

The application of pilot fluid to the line 26 will cause the locking piston 116 to move downwardly thereby freeing the small spool 90 for movement, as may be required.

Initially, because the valve member 62 will be seated against the seat 66, there will be little or no pressurized fluid in the conduit 80 and, thus, little or no pressure applied to the underside of the spool 90 within the chamber 110. Accordingly, the spring 96 will move the spool 90 downwardly and the groove 92 will establish fluid communication between the ports 106 and 108, thereby venting fluid from the chamber 74. As a consequence, and because the passage 82 within the valve member 62 provides for restricted flow, pressure within the annulus 64 due either to the loading of the cylinder 10 or the application of pressure to the rod end through the port 16, or both, will act against the shoulder 120 on the valve member 62 and cause the same to shift to the right. The rate of such shifting will be restricted by the rate of fluid flow from the port 108 to the port 106. Consequently, when the valve 62 moves rightwardly for this particular operative condition, it will not move fully rightwardly to establish free flow but only sufficiently rightwardly so as to allow metering flow through the metering slots 70. As such flow occurs, pressure will begin to build up in the conduit 80 and a greater pressure will be exerted against the underside of the spool 90 which will tend to diminish fluid communication between the ports 108 and 106 by upward shifting of the groove 92 with the spool 90.

Pressure will begin to build up in the conduit 80 by reason of the presence of the flow restriction posed by the metering slots 56 in the flow path to the reservoir 14.

Quite rapidly, a steady state condition will result with the valve member 62 positioned close to, but not against, the valve seat 66 to control the rate of fluid flow from the port 18 and thereby control, for example, the rate of descent of a load or the like. Should the load begin to increase the pressure at the port 18, that will, of course, tend to cause the valve 62 to shift somewhat to the right. However, due to the presence of the metering slots 56 and the fact that the spool 90 is sensing a pressure differential, namely, that between the conduit 112 and the manifold 102, there will be an increase in pressure in the conduit 80 resulting in further upward movement of the spool 90 to further decrease the rate of flow from the chamber 74. As a consequence, fluid under pressure from the annulus 64 will begin to fill the chamber 74 via the passage 82 which will move the valve member 62 to the left to restore the desired flow rate and thereby maintain a desired rate of travel of the load controlled by the motor 10.

When the spool 28 is centered in the manner shown, it will be appreciated that the valve 62 will be fully seated against the seat 66, thereby serving as a check valve to prevent creeping of any load associated with the cylinder 10.

From the foregoing, it will be appreciated that a hydraulic system made according to the invention enables the use of a single valve for the dual function of providing a check valve type action and a flow control action, functions heretofore requiring two valves. The unique use of a relatively small spool 90 as the control for the combination check and flow control valve is highly desirable in that the excellent flow control characteristics normally associated with spools can be utilized in controlling the valve 62. At the same time, because the spool 90 is small, as mentioned previously, leakage characteristics are relatively minute, unlike those associated with large spools, such as the spool 28.

It will also be appreciated that the invention provides a lock whereby the system cannot be defeated in terms of the piston 116 employed to disable the spool 90 in the manner mentioned previously.

Because the passage 82 will typically be provided with an orifice (not shown) to achieve the previously mentioned metering function, when fluid is directed to the port 18, the valve member 62 may not shift to an open position as quickly as might be desired in some situations due to flow limiting in the passage 82 of fluid in the chamber 74 flowing to the annulus 64. To increase response in such a case, a check valve (not shown) can be added to interconnect the chamber 74 and the annulus 64 in parallel with the restriction in the passage 82. The check valve will be oriented to open whenever pressure in the chamber 74 exceeds that in the annulus 64 and thus provides a bypass for the restriction in the passage 82.

The embodiments of the invention in which an exclusive property or privilege is claimed are defined as follows:

1. A hydraulic system comprising:

a hydraulic pump;

a hydraulic motor having at least one port;

a hydraulic reservoir;

a main spool valve interposed between said motor and said pump and reservoir and having a spool shiftable between positions (a) connecting said pump to said port, (b) connecting said reservoir to said port, and (c) blocking fluid flow to or from said port;

a single, combination check and flow control valve interposed between said main spool valve and said port and having a valve seat, a valve member seatable thereagainst, a spring biasing said valve member towards said seat, a pressure responsive surface adapted to act in contact with said spring, said pressure responsive surface being open to the pressure in said motor, and flow metering means for metering fluid flow through said combination valve when said valve member is close to said seat, said valve member being movable between (a) a position closed against said seat, (b) a variety of positions close to said seat for metering fluid flow, and (c) a position remote from said seat for allowing relatively free fluid flow;

sensing means for sensing a pressure differential across said main spool valve, said sensing means being acted upon by pressure between said main spool valve and said combination check and flow control valve and by pressure in a line leading to reservoir; and means responsive to said sensing means for relieving the pressure at said pressure responsive surface.

2. The hydraulic system of claim 1 further including means for disabling said relieving means when said spool is in position (a) thereof.

3. The hydraulic system of claim 1 further including means for enabling said relieving means only when said spool is in position (b) thereof.

4. A hydraulic system comprising:

a hydraulic pump;

a hydraulic motor having at least one port;

a hydraulic reservoir;

a main spool valve interposed between said motor and said pump and reservoir and having a spool shiftable between positions (a) connecting said pump to said port, (b) connecting said reservoir to said port, and (c) blocking fluid flow to or from said port;

a single, combination check and flow control valve interposed between said main spool valve and said port and having a valve seat, a valve member seatable thereagainst, a spring biasing said valve member towards said seat, a pressure responsive surface adapted to act in concert with said spring, and flow metering means for metering fluid flow through said combination valve when said valve member is close to said seat, said valve member being movable between (a) a position closed against said seat, (b) a variety of positions close to said seat for metering fluid flow, and (c) a position remote from said seat for allowing relatively free fluid flow, said valve member further being related to said main spool valve to be movable against the bias of said spring to position (c) thereof when subjected to pressure fluid from said pump;

a fluid passage interconnecting said pressure responsive surface and said port;

a small spool valve responsive to differential pressure for metering flow from said pressure responsive surface to said reservoir; and differential pressure means for controlling said small spool valve including a fluid connection to the interface of said main spool valve and said combination valve and a fluid connection to said reservoir.

5. The hydraulic system of claim 4 wherein said main spool valve is pilot operated, and wherein said small spool valve includes a pilot operated lock for preventing flow of fluid through said small spool valve to said reservoir, the pilots of said lock and said main spool valve being interconnected such that said lock will be disabled only when the main spool valve pilot is shifting said spool to position (b) thereof.

6. The hydraulic system of claim 4 further including a lock for preventing said small spool valve from metering fluid to said reservoir, an actuator for said spool for moving said spool between said positions thereof, and means interconnecting said lock and said actuator for disabling said lock when said actuator has moved said spool to position (b) thereof.

7. The hydraulic system of claim 4 wherein said small spool valve includes a small spool with first and second opposed pressure responsive surfaces, said first surface being connected by said fluid connection to said interface, a spring biasing and engaging said small spool in bucking relation to said first surface, and means connecting said second surface to said main spool valve on the reservoir side thereof.

8. The hydraulic system of claim 5 wherein said pilot-operated lock includes a movable lock member physically movable into and out of engagement with said small spool valve.

* * * * *